US010618328B2

(12) United States Patent
O'Hara et al.

(10) Patent No.: US 10,618,328 B2
(45) Date of Patent: Apr. 14, 2020

(54) WEB MATERIAL APPLICATOR FOR A FLUID EJECTION DEVICE

(71) Applicant: Hewlett-Packard Development Company, L.P., Houston, TX (US)

(72) Inventors: Steve A O'Hara, Camas, WA (US); Scott Martin, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/773,513

(22) PCT Filed: Mar. 2, 2016

(86) PCT No.: PCT/US2016/020475
§ 371 (c)(1),
(2) Date: May 3, 2018

(87) PCT Pub. No.: WO2017/151125
PCT Pub. Date: Sep. 8, 2017

(65) Prior Publication Data

US 2018/0319185 A1 Nov. 8, 2018

(51) Int. Cl.
*B41J 29/17* (2006.01)
*B41J 2/165* (2006.01)

(52) U.S. Cl.
CPC ..... *B41J 29/17* (2013.01); *B41J 2/16535* (2013.01); *B41J 2/16552* (2013.01); *B41J 2002/1655* (2013.01)

(58) Field of Classification Search
CPC .... B41J 29/17; B41J 2/16552; B41J 2/16535; B41J 2002/1655
See application file for complete search history.

(56) References Cited

U.S. PATENT DOCUMENTS

| | | | | |
|---|---|---|---|---|
| 7,677,717 | B2 | 3/2010 | Islam et al. | |
| 8,139,981 | B2 | 3/2012 | Ziegelmuller et al. | |
| 8,851,628 | B2 | 10/2014 | Love et al. | |
| 2007/0059083 | A1 | 3/2007 | Silverbrook et al. | |
| 2008/0026201 | A1* | 1/2008 | Rizika | B32B 5/18 428/304.4 |
| 2008/0266342 | A1 | 10/2008 | Steinfield et al. | |
| 2009/0179927 | A1 | 7/2009 | Hibbard et al. | |
| 2013/0106951 | A1* | 5/2013 | Karppinen | B41J 2/16547 347/33 |
| 2013/0257980 | A1 | 10/2013 | Ibe et al. | |

(Continued)

FOREIGN PATENT DOCUMENTS

| | | | |
|---|---|---|---|
| EP | 0805043 | A2 | 11/1997 |
| EP | 1350627 | A1 | 10/2003 |

(Continued)

*Primary Examiner* — Henok D Legesse
(74) *Attorney, Agent, or Firm* — Mannava & Kang

(57) ABSTRACT

According to an example, a supply reel may contain a web material sheet and a take-up reel that is to pull the web material sheet from the supply reel. A static web material applicator may be positioned in a feed direction of the web material sheet from the supply reel to the take-up reel. The web material sheet may slide over the web material applicator as the web material sheet is fed from the supply reel to the take-up reel. In addition, the web material applicator may cause the web material sheet to wipe a surface of a fluid ejection device.

15 Claims, 6 Drawing Sheets

(56) References Cited

U.S. PATENT DOCUMENTS

| | | | |
|---|---|---|---|
| 2015/0191018 | A1 | 7/2015 | Ozaki |
| 2016/0031220 | A1 | 2/2016 | Murayama |

FOREIGN PATENT DOCUMENTS

| | | | |
|---|---|---|---|
| EP | 1557270 | A1 | 7/2005 |
| JP | 2013-184471 | A | 9/2013 |
| JP | 2014-148128 | A | 8/2014 |
| WO | WO-2007030854 | | 3/2007 |
| WO | WO-2015012788 | | 1/2015 |

* cited by examiner

WEB MATERIAL APPLICATOR FOR A FLUID EJECTION DEVICE

BACKGROUND

Certain types of printers employ a print cartridge with a reservoir to hold a fluid, powder or other printing material. In these types of printers, the printing material passes from the reservoir through a multiplicity of nozzles to be ejected onto a print medium or a print bed. The print cartridge moves up and down to print and wipe positions. The print medium is advanced past the print carriage to enable printing of a desired image or images on the print medium. In 3D printers, the print bed may be lowered during a printing process to build up a 3D printed object.

BRIEF DESCRIPTION OF THE DRAWINGS

Features of the present disclosure are illustrated by way of example and not limited in the following figure(s), in which like numerals indicate like elements, and in which.

DETAILED DESCRIPTION

Printers that employ fluid ejection devices (or equivalently, print heads) generally apply printing material in a single smooth motion as either the print heads or a media is moved with respect to the other. During usage, the print cartridge nozzles may become plugged with blobs or particulate from the printing material, or may otherwise become contaminated with internal bubbles that prevent the nozzles from operating properly. Such blockages often result in lower print quality. As a result, an inoperable nozzle in a print head may produce a noticeable streak on the media. To identify potentially inoperable nozzles, the operational state of each of the potentially thousands of nozzles included in the print head may be periodically measured. In addition, the print head may be serviced periodically to clean the nozzles and keep them functioning properly. Printers typically include a service station or a service sled that provides for spitting, wiping, capping and priming of each print head in order to keep the nozzles clean and functioning properly. The service sled system cleans the print head nozzles to keep the nozzles substantially free of particulate materials such as ink and debris. Such cleaning may keep the nozzles firing properly throughout the life of the print head.

In order to execute functions such as wiping and capping, the service sled is moved underneath the print head or the print head is moved over the service sled, so that a web material on the service sled makes contact with the nozzles on the print head. According to an example, the functionality of the service sled may be enhanced through implementation of a web material applicator, which remains static as a web material sheet is used to clean a surface of the print head and while the web material sheet is moved over the web material applicator. For instance, the web material applicator disclosed herein may include a functional surface that is periodically refreshed with an unused portion of the web material. In contrast to other types of cleaning systems that have a moveable web material applicator that also acts as a drive roller in which eight functional surfaces are constantly recycled for the wiping function, the web material application disclosed herein may include a single functional surface that is refreshed for a wiping function.

In one regard, the static arrangement of the example web material applicator disclosed herein may reduce the number of parts used to provide the wiping function thereby increasing the longevity and reliability of the servicing system. Moreover, instead of the heavy steel roller and custom extruded foam used with other types of servicing systems, the example web material application disclosed herein may use a lightweight aluminum roller that has a stock foam sheet affixed thereto.

Figure 1A:
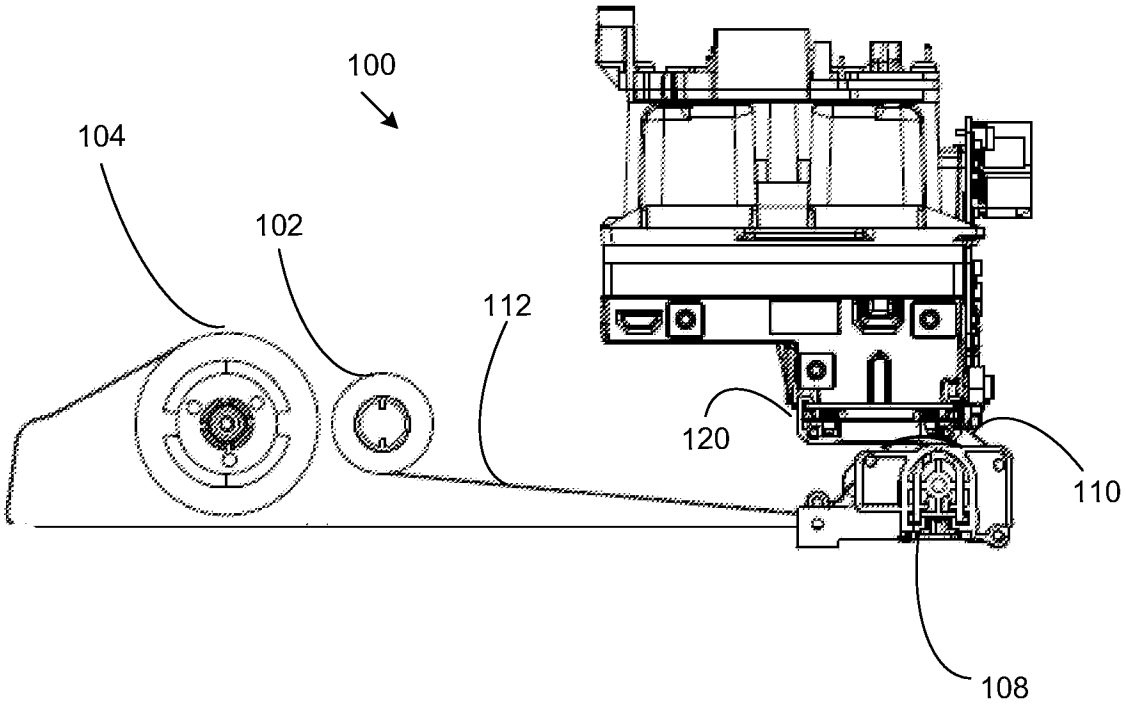
FIG. 1A is a side view of an example reel to reel system that includes an example web material applicator.

With reference first to FIG. 1A, there is shown a side view of an example reel to reel system 100 that includes an example web material applicator 108. As shown, the reel to reel system 100 may include a supply reel 102 that carries a web material rolled onto the supply reel 102 as a sheet of material 112. The reel to reel system 100 may also include a take up reel 104 that takes up or pulls the web material sheet 112 from the supply reel 102. As shown, the supply reel 102 may rotate in a counter-clockwise direction and the take up reel 104 may rotate in the clockwise direction to cause the web material sheet 112 to travel from the supply reel 102 to the take up reel 104.

The reel to reel system 100 may also include the example web material applicator 108, which is depicted as being positioned in a feed direction of the web material sheet 112 from the supply reel 102 to the take up reel 104. The web material sheet 112 may slide over the web material applicator 108 which remains static and does not rotate as the web material sheet 112 is fed from the supply reel 102 to the take up reel 104. According to an example, the web material applicator 108 is to position a portion of the web material sheet 112 to be in contact with a surface of a fluid ejection device 120 such that a functional surface 110 of the web material sheet 112 may wipe or otherwise clean the contacted surface of the fluid ejection device, such as a surface near the nozzles of the fluid ejection device. In an example, the web material sheet 112 may be made of a cloth or other at least partially absorbent material to clean the contacted surface.

Figure 1B:
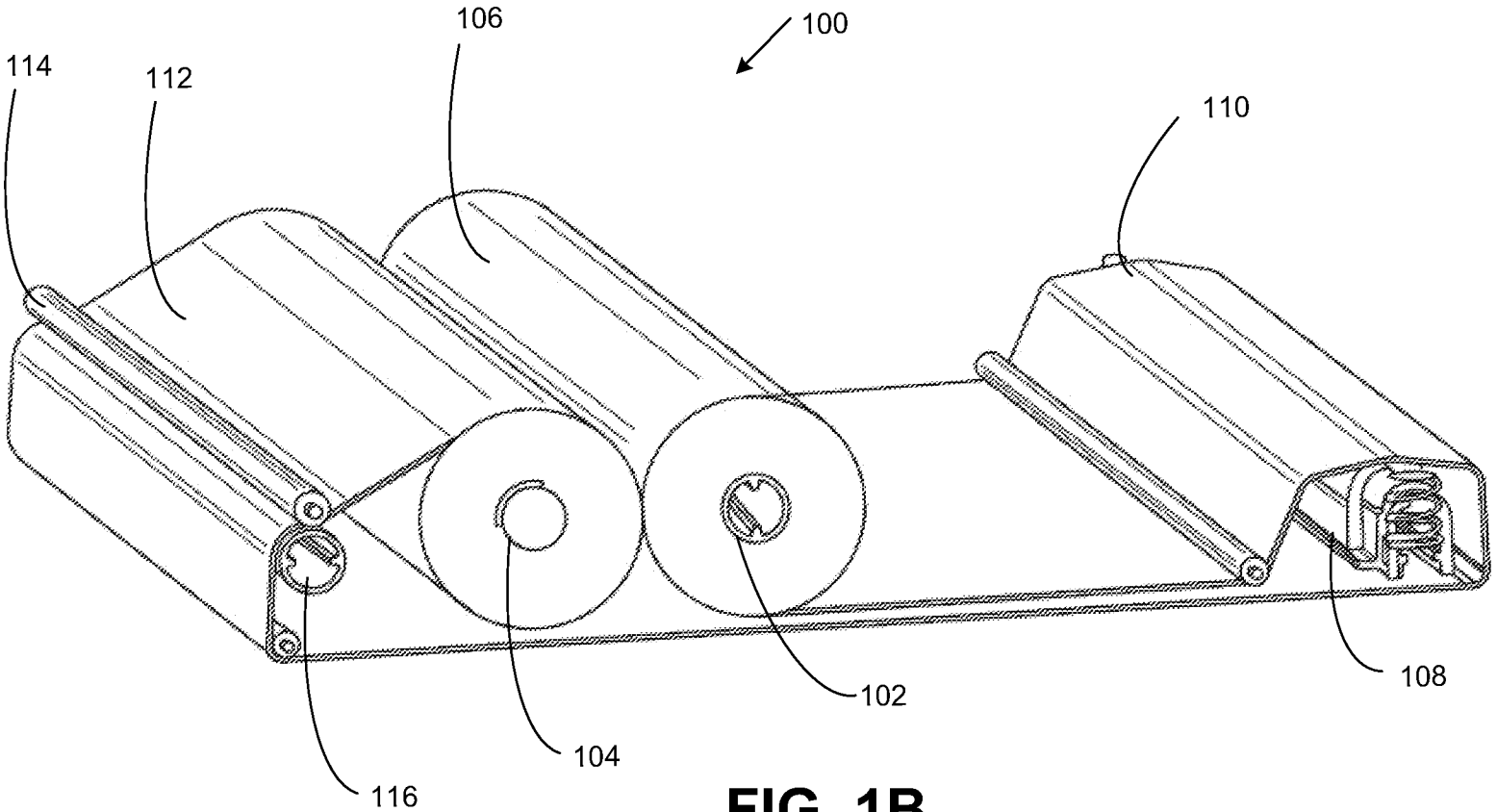
FIG. 1B is an isometric view of an example reel to reel system that includes an example web material applicator.

FIG. 1B is an isometric view of an example reel to reel system that includes an example web material applicator. As discussed in greater detail herein below, the web material applicator 108 may include a U-shaped cross section and may remain static/stationary, i.e., does not rotate, while the web material sheet 112 is moved over the web material applicator 108 from the supply reel 102 to the take up reel 104. In an example, the web material applicator 108 may be formed of a rod made of lightweight materials such as aluminum.

The functional surface 110, may contact nozzles in the fluid ejection device 120 (or equivalently, a print head) for carrying out various functions such as but not limited to wiping. As the functional surface 110 of the web material sheet 112 is used for the various functions, the portion of the web material sheet 112 forming the functional surface 110 may become soiled with printing material, particulates and the like, which may have been removed from the print head while servicing the nozzles. Hence, the portion of the web material sheet 112 that forms the functional surface 110 may be periodically refreshed or replaced with new, unused web material 106 from the supply reel 102. During a refresh operation, the web material sheet 112 may be moved via rotation of the take up reel 104 which in turn causes the supply reel 102 to rotate and release a fresh portion of the unused web material 106. The web material sheet 112 may be passed over the web material applicator 108 as the web material sheet 112 is transferred from the supply reel 102 to the take up reel 104. Thus, the functional surface 110 at which various servicing functions may be carried out by a service sled may be refreshed with a new and unused portion of the web material sheet 112 supplied by the supply reel 102. In this regard, a portion of the web material sheet 112 may be used as the functional surface 110 for a particular time period until that portion is refreshed. In an example, the supply reel 102 may be provisioned with sufficient web material 106 for servicing nozzles of print heads over the lifetime of the printer.

The web material sheet 112 is driven through the reel to reel system 100 by the friction shaft 116 and the pinch shaft 114. The pinch shaft 114 pinches the web material sheet 112 and allows for a linear amount of the web material 112 to be fed in each rotation of the take up reel 104. The web material sheet 112 thus released from the supply reel 102 is gathered on the take up reel 104 using a slip clutch (not shown). The slip clutch allows the take up reel 104 to grow and to over-rotate as the diameter of the take up reel 104 grows.

Figure 2:
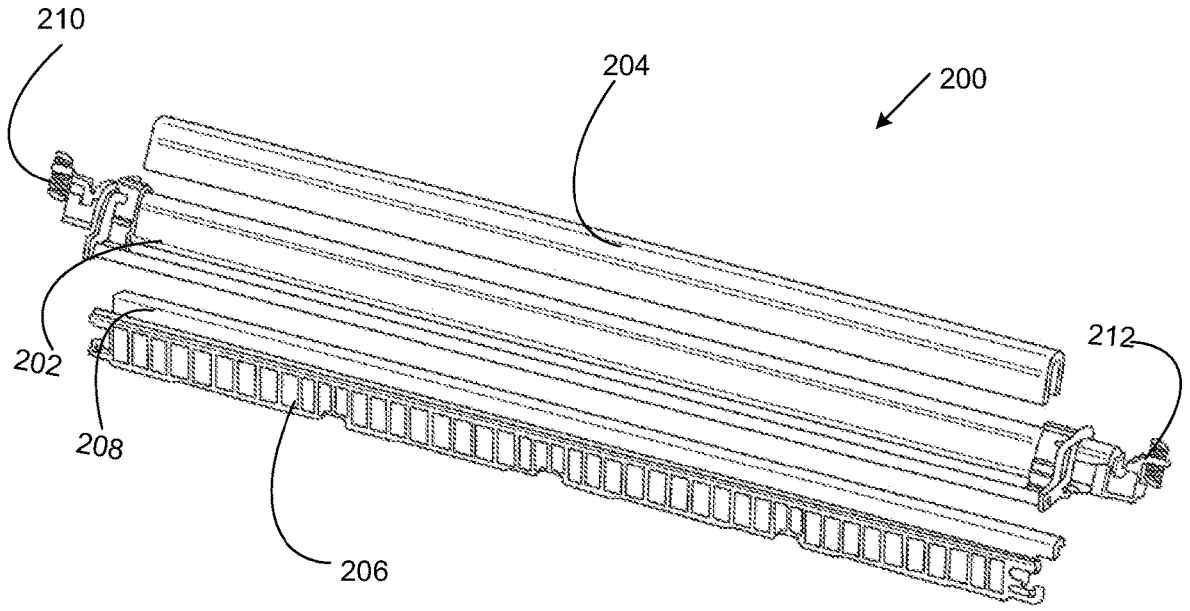
FIG. 2 is an exploded isometric view of the example web material applicator depicted in FIG. 1B.

FIG. 2 is an exploded isometric view 200 illustrating details of the example web material applicator 108 depicted in FIG. 1B. The core of the web material applicator 108 includes a lightweight metallic rod 202, which may be composed of a material such as, aluminum, or the like. A pre-cut foam sheet 204 may be affixed to the metallic rod 202. As the web material applicator 108 is static, i.e., does not rotate, the pre-cut foam sheet 204 may not need to undergo an expensive grinding procedure like the custom foam sheets employed in web material applicators that use drive rollers. As such, the pre-cut foam sheet 204 may be relatively simpler to fabricate as compared with web material applicators that rotate.

The portion of the web material sheet 112 that passes over the rod 202 having the pre-cut foam sheet 204 may form the functional surface 110. In addition, a low friction guide 206 may be included in the web material applicator 108. The rod 202 with the pre-cut foam sheet 204 may be slotted into a space or a groove 208 within the guide 206. The guide 206 may be used to move or guide the web material sheet 112 over the web material applicator 108 so that a fresh portion of the web material sheet 112 may replace a soiled portion of the web material sheet 112 during a refresh operation. In particular, the web material sheet 112 may pass from the supply reel 102 underneath the guide 206 and over the web material applicator 108. Two springs 210 and 212 located on either side of the rod 202 may enable the web material applicator 108 to be attached to a printer service sled and provide the suspension mechanism that enables the web material applicator 108 to apply the web material sheet 112 to a surface of the print head with a designed force. The functional surface 110 may thus be bought into contact with the nozzles or other portions of the print head that are to be serviced.

Figure 3:
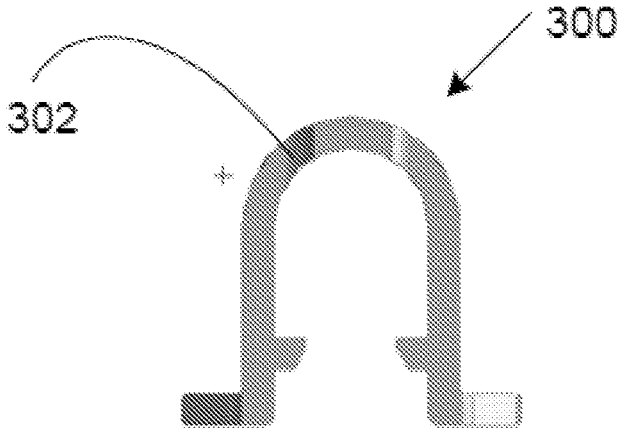
FIG. 3 is a cross-sectional side view of the rod depicted in FIGS. 1 and 2.

FIG. 3 is a cross-sectional side view 300 of the rod 202 depicted in FIGS. 1 and 2. The rod 202 may be formed of a light-weight material such as, but not limited to, aluminum. As discussed herein, the web material applicator 108 is static and therefore, does not rotate. In one example, and as shown in FIG. 3, the rod 202 may form an inverted U-shape in cross section. That is, the rod 202 may include a curved surface 302 over which the web material sheet 112 may traverse. It should be understood that the cross-sectional shape of the rod 202 shown in FIG. 3 is for purposes of illustration and that any other suitable shape may be used for the web material applicator 108 so long as the web material applicator 108 does not rotate.

Figure 4:
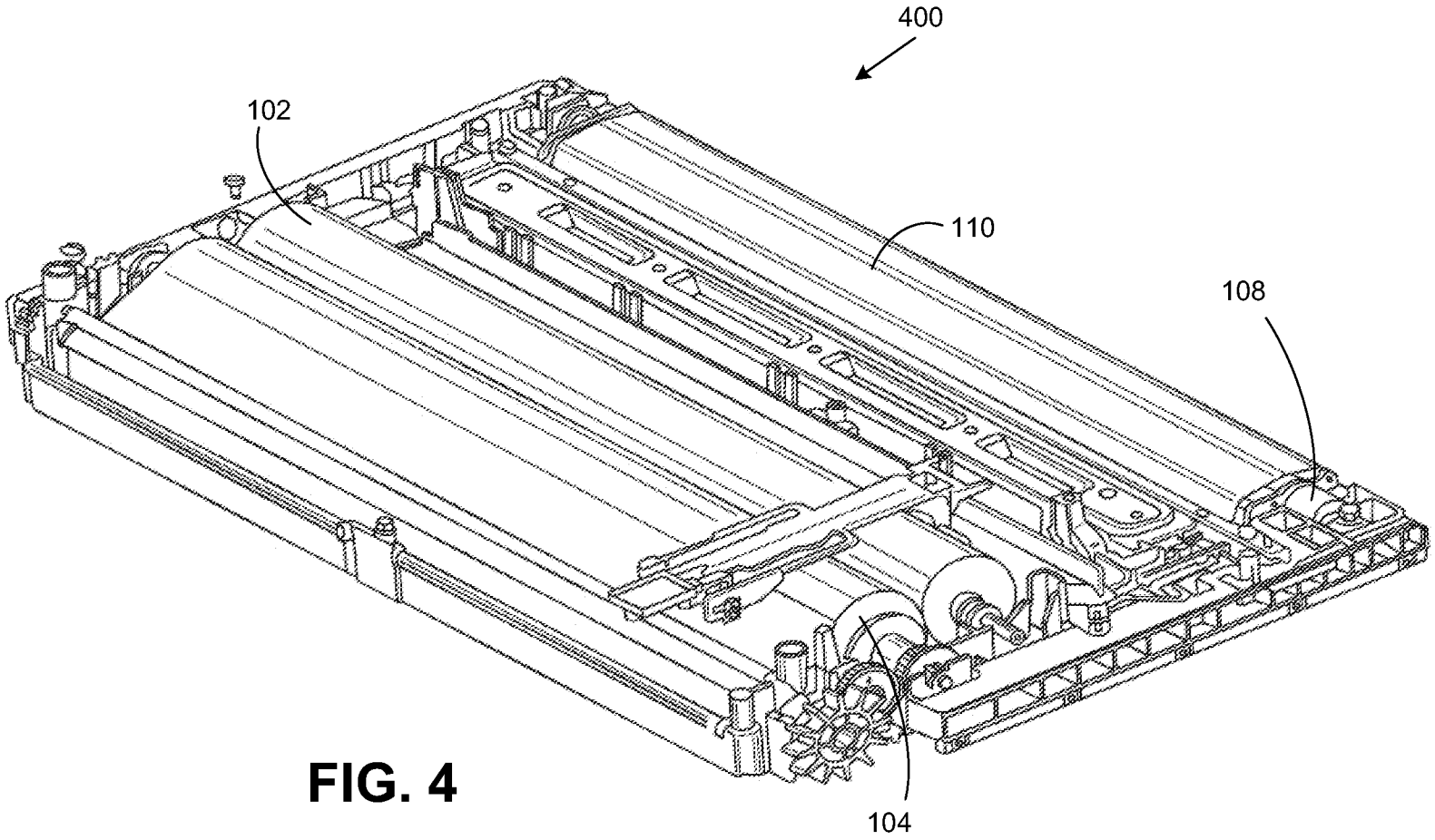
FIG. 4 shows an isometric view of an example service sled including the example web material applicator depicted in FIGS. 1A, 1B, and 2.

FIG. 4 shows an isometric view of an example service sled 400 including the web material applicator 108 depicted in FIGS. 1 and 2. The functional surface 110 of the web material applicator 108 may be brought into contact with the nozzles of a print head during servicing via the suspension mechanisms 210 and 212 (FIG. 2). When it is time to refresh the portion of the web material sheet 112 that forms the functional surface 110, the take up reel 104 may be rotated thereby pulling the web material sheet 112 from the supply reel 102. Thus, a fresh, unused portion of the web material sheet 112 may be positioned to form the functional surface 110. As the web material applicator 108 does not rotate, the number of moving parts in the sled 400 may be relatively smaller when compared to a web material applicator that has a drive roller. However, the functions associated with the servicing may be maintained thereby reducing the cost of the service sled including the web material applicator 108 while increasing the reliability/longevity of the service sled.

Figure 5:
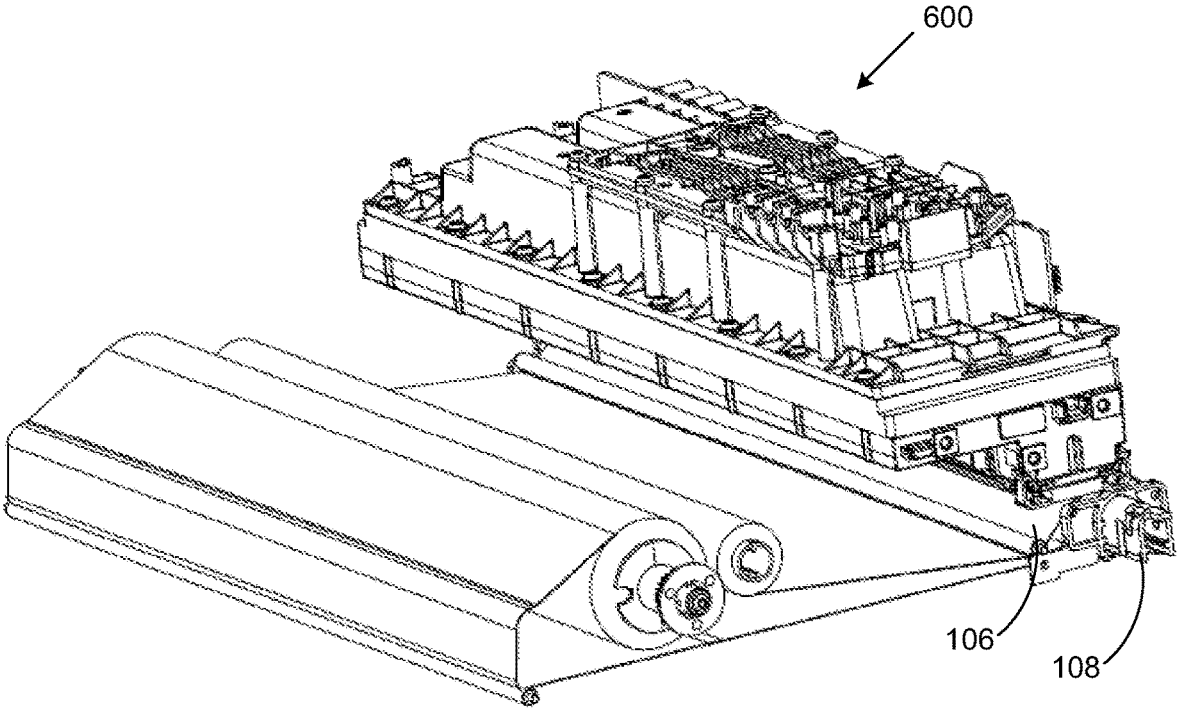
FIG. 5 is an isometric view of the example web material applicator depicted in FIGS. 1A, 1B, and 2 in contact with a print head.

FIG. 5 is an isometric view 500 of the example web material applicator depicted in FIGS. 1A, 1B, 2, and 5 in contact with a print head.

Figure 6:
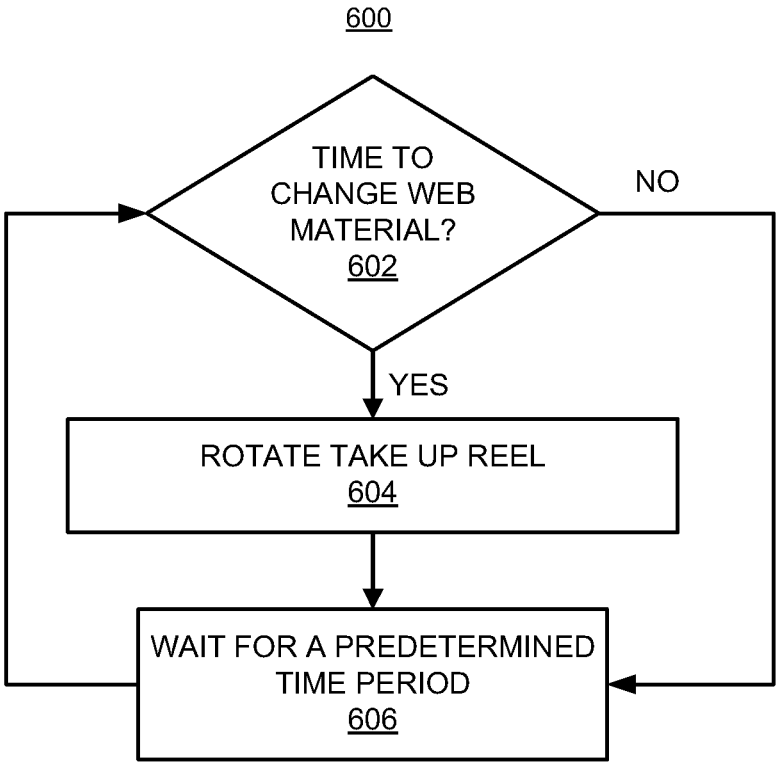
FIG. 6 is a flowchart of an example method of refreshing a functional surface of a web material sheet using the example web material applicator depicted in FIGS. 1A-5.

FIG. 6 is a flowchart of an example method 600 of refreshing a functional surface of a web sheet material using the example web material applicator 108 depicted in FIGS. 1A-5. In an example, a processor (not shown) included in a printer that also includes the web material applicator 108 may execute instructions stored in a memory (also included in the printer) to carry out the method for refreshing the web material as disclosed herein. At block 602, a determination may be made as to whether a time to change or refresh the functional surface 110 of the web material sheet 112 has been reached. The processor may determine the time to refresh the functional surface 110 based on an elapsed time period and/or as a function of usage of the printer. If it is not yet time to change or refresh the functional surface 110 of the web material sheet 112, the method proceeds to block 606. At block 606, the processor may wait for a predetermined time period until another determination is made at block 602 regarding the timing for refreshing the functional surface 110.

If it is determined at block 602 that it is time to refresh the functional surface 110 of the web material sheet 112, the take up reel 104 may be rotated as indicated at block 604. As a result, the web material sheet 112 is pulled from the supply reel 102 over the web material applicator 108 and a new portion of the web material sheet 110 may be positioned over the web material applicator 108 and form the functional surface 110. At block 606, the processor may wait for a predetermined time period. When the predetermined time period elapses, the method 600 may be repeated from block 602. Thus, the same portion of the web material sheet 112 may be used as the functional surface 110 to carry out the various servicing functions until the predetermined time period or usage counter elapses and a determination is made to refresh the functional surface 110 of the web material sheet 112. This may reduce the number of parts that form the web material applicator 108 as compared to a web material applicator that uses drive rollers. Moreover, the functions of the drive roller and application of the web material may be split between the supply reel 102/take up reel 104 and the web material applicator 108. The reduction of parts and splitting of tasks between various apparatus may increase the longevity and reliability of a printer including the web material applicator 108 and may make the printer more cost effective.

Figure 7:
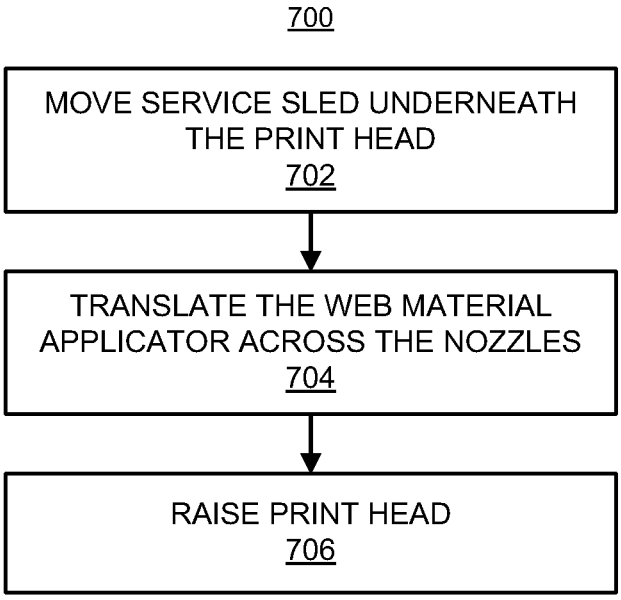
FIG. 7 is a flow chart of an example method for performing a servicing operation using the web material applicator depicted in FIGS. 1A-5.

FIG. 7 is a flow chart of an example method 700 for performing a servicing operation using the web material applicator depicted in FIGS. 1A-6. The servicing operation may include, for instance, a wiping operation carried out by a service sled 400 using the web material applicator 108. At block 702, the service sled 400 may be moved underneath the print head such that the functional surface 110 of the web material sheet 112 makes contact with the nozzles of the print head. At block 704, the web material applicator 108 may be translated across the nozzles, for instance, using the suspension mechanism including the springs 210 and 212, to clean the nozzles using the functional surface 110. At block 706, the print head may be raised so that the nozzles are no longer in contact with the functional surface 110.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein are examples of the disclosure along with some variations. The terms, descriptions and figures used herein are set forth by way of illustration and are not meant as limitations. Many variations are possible within the scope of the disclosure, which is intended to be defined by the following claims, and their equivalents, in which all terms are meant in their broadest reasonable sense unless otherwise indicated.

What is claimed is:

1. An apparatus comprising:

a supply reel containing a web material sheet;

a take-up reel to take-up the web material sheet from the supply reel; and a web material applicator positioned in a feed direction of the web material sheet from the supply reel to the take-up reel, wherein the web material applicator is to cause the web material sheet to wipe a surface of a fluid ejection device, and wherein the web material sheet is to slide over the web material applicator as the web material sheet is fed from the supply reel to the take-up reel and the web material applicator is to be maintained in a static position with respect to the feed direction during wiping of the web material sheet on the surface of the fluid ejection device.

2. The apparatus of claim 1, wherein the web material sheet is a sheet of material to be used to wipe nozzles of the fluid ejection device.

3. The apparatus of claim 1, wherein the web material applicator comprises a U-shaped cross section.

4. The apparatus of claim 1, wherein the web material applicator further comprises a shaft that includes a lightweight aluminum rod.

5. The apparatus of claim 4, wherein the shaft further comprises a pre-cut foam sheet attached to the lightweight aluminum rod.

6. The apparatus of claim 4, further comprising a guide to guide the web material sheet over the web material applicator.

7. The apparatus of claim 6, wherein the guide further comprises a groove that receives the rod.

8. The apparatus of claim 1, further comprising a suspension mechanism that causes the web material applicator to apply even pressure to push the web material sheet into contact with the surface of the fluid ejection device.

9. A web material applicator comprising:

a rod with a U-shaped cross section;

a pre-cut foam sheet attached to the rod; and a guide comprising a slot that receives the rod.

10. The web material applicator of claim 9, wherein the rod is made of aluminum.

11. The web material applicator of claim 9, further comprising at least two springs arranged on either side of the rod to enable the web material applicator to push a web material into contact with a surface of a print head.

12. The web material applicator of claim 9, wherein a portion of a web material that forms a functional surface passes over a curved surface of the rod.

13. The web material applicator of claim 12, wherein the web material comprises an at least partially absorbent component.

14. A method, comprising:

determining that a portion of a web material sheet that forms a functional surface is to be refreshed;

rotating a take up reel of a printer service sled such that the web material sheet is pulled from a supply reel of the printer service sled and slid over a web material applicator so that the functional surface that contacts a print head is refreshed, wherein the web material applicator is to remain static with respect to a direction in which the web material sheet is moved over the web material applicator; and waiting for a predetermined time period or usage counter to elapse before making another determination regarding refreshment of the functional surface.

15. The method of claim 14, further comprising:

activating a suspension mechanism of the web material applicator to cause the functional surface to wipe nozzles of the print head.

* * * * *